United States Patent [19]

Spademan

[11] 4,407,520

[45] Oct. 4, 1983

[54] SKI BOOT LOCATING APPARATUS

[76] Inventor: Richard G. Spademan, 130 Country Club Dr. #30, Incline Village, Nev. 89450

[21] Appl. No.: 255,623

[22] Filed: Apr. 20, 1981

[51] Int. Cl.[3] ..... A63C 9/08

[52] U.S. Cl. ..... 280/624

[58] Field of Search ..... 280/624, 625, 618, 636, 280/623

[56] References Cited

U.S. PATENT DOCUMENTS

| | | | |
|---|---|---|---|
| 3,271,040 | 9/1966 | Spademan | 280/624 |
| 3,560,011 | 2/1971 | Spademan | 280/624 |
| 3,606,370 | 9/1971 | Spademan | 280/624 |
| 3,884,492 | 5/1975 | Spademan | 280/624 |
| 3,891,227 | 6/1975 | Spademan | 280/624 |
| 4,063,752 | 12/1977 | Whitaker et al. | 280/624 |
| 4,135,736 | 1/1979 | Druss | 280/636 |

*Primary Examiner*—Joseph F. Peters, Jr.
*Assistant Examiner*—Michael Mar
*Attorney, Agent, or Firm*—Townsend and Townsend

[57] ABSTRACT

In a ski binding (1) there is provided ski boot heel locating members (30, 31) for locating a ski boot mounted plate (3) between a pair of clamping members (16, 17). The plate member 3 is provided with curved lateral edges (4, 5) the forward edge of which is provided with a length and angle for moving the plate (3) and the ski boot (2) to which it is attached forwardly at a distance sufficient for the heel of the ski boot (2) to clear the forward edge of the heel locating members (30, 31) during a lateral release as the plate (3) and clamping members (16, 17) are engaged.

1 Claim, 5 Drawing Figures

SKI BOOT LOCATING APPARATUS

BACKGROUND OF THE INVENTION

The present invention relates to ski binding apparatus in general and, more specifically, to a ski boot locating apparatus for centering a ski boot in a ski binding of the type designed for releasably securing the ski boot to the ski rearward of the toe and forward of the rear of the heel of the ski boot as disclosed in U.S. Pat. Nos. 3,271,040, 3,606,370, 3,891,227 and 4,063,752.

In each of the above patents there is disclosed and described separable ski and boot mounted members. The members are provided for releasably securing the ski boot to a ski rearward of the toe and forward of the rear of the heel of a ski boot. In each of the embodiments thereof the ski and boot mounted members comprise a pair of side clamping members and a curved plate member. In one embodiment, the side clamping members are movable and mounted on a ski. The plate member is a rigid member with curved lateral edges and is mounted to the sole of the ski boot. In another embodiment, the movable clamping members are formed as plate-like clamping members with curved lateral edges and means for mounting the members on the sole of the ski boot. The ski mounted member comprises nonmovable upstanding members with inwardly facing protuberances for engaging the movable plate-like clamping members.

When inserting a conventional ski boot in any of the above described bindings, it is necessary to center the ski boot and its clamping members between the ski-mounted clamping members; but frequently this is difficult.

Conventional ski boots are generally constructed with a relatively wide lower shell with portions thereof in the vicinity of the clamping members overhanging the soles thereof. Without a clear view of the clamping members by the skier because of the width and overhanging construction of the typical ski boot shell, centering of the boot mounted clamping members between the ski mounted clamping members is often difficult. Frequently, to obtain a better view of the clamping members, a skier rolls the ski boot about the longitudinal axis thereof. This tends to remove the boot mounted clamping members from between the ski mounted clamping members. For these reasons, it is found to be particularly difficult to center the boot mounted clamping members between the ski mounted clamping members in deep snow, on icy surfaces and on steep slopes.

SUMMARY OF THE INVENTION

For the foregoing reasons, a principal object of the present invention is a ski binding having a boot mounted and ski mounted clamping members for releasably securing a ski boot to a ski rearward of the toe and forward of the rear of the heel of the ski boot. In the binding there is provided a heel locating means for removably receiving the heel of the ski boot for centering the boot mounted clamping members between the ski mounted clamping members prior to closing of the binding.

In accordance with the above objects a heel receiving means is provided with a curved surface corresponding to the shape of the rear surface of the heel of the ski boot and is mounted on the rear of the binding.

To facilitate removal of the heel of the ski boot from the heel receiving means, means are provided for moving the heel of the ski boot forwardly as the binding is closed.

To move the heel of the ski boot forwardly when the binding is closed, one of the clamping members is plate shaped. The plate shaped clamping member is provided with curved lateral edges, having a forward portion with a length and angle sufficient for moving the said ski boot forwardly a distance sufficient for the heel of said ski boot to clear the forward edges of the heel locating means during a lateral release as the plate and mating clamping members are engaged.

BRIEF DESCRIPTION OF THE DRAWING

The above and other objects, features and advantages of the present invention will become apparent from the following detailed description of the drawing in which.

DETAILED DESCRIPTION OF THE DRAWING

Figure 1:
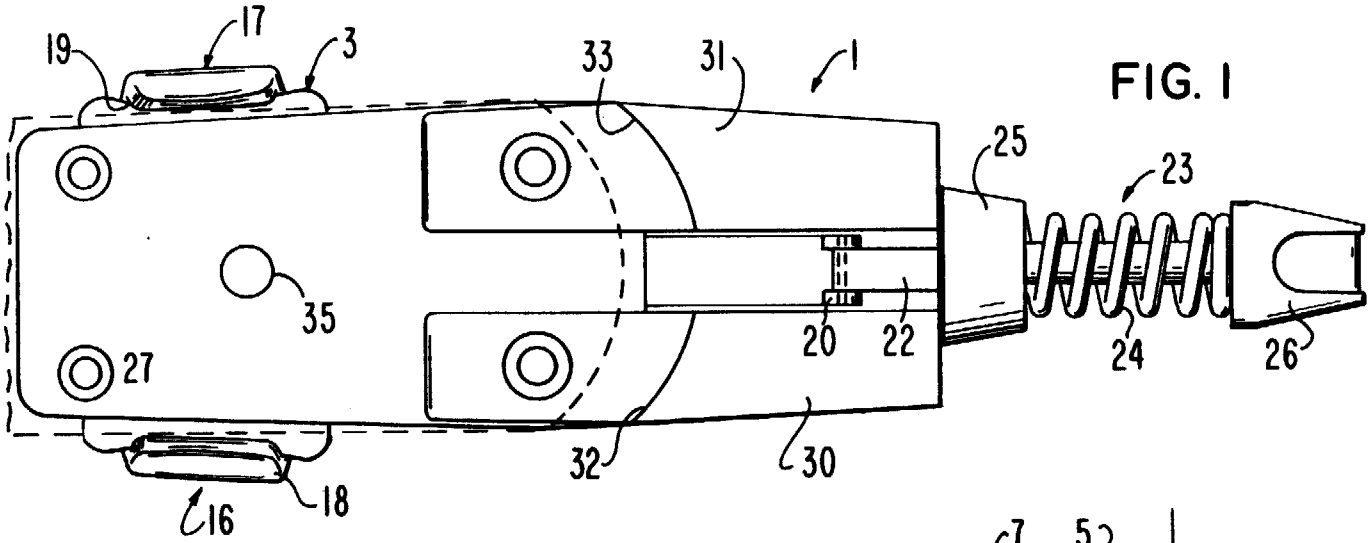
FIG. 1 is a plan view of a binding according to the present invention with the binding in a closed condition.

Referring to FIGS. 1-5 there is provided in accordance with the present invention a ski binding designated generally as 1 for releasably securing a ski boot 2, the outline of which is shown in dashed lines, to a ski 11 rearward of the toe and forward of the rear of the heel of the ski boot.

Mounted to the bottom of the ski boot 2 there is provided a plate member 3. As seen more clearly in FIG. 3, the plate member 3 is symmetrical about the longitudinal axis thereof and is provided with a pair of inwardly curved lateral edges 4 and 5, a pair of forward tip members 6 and 7 and a pair of rearward tip members 8 and 9. For mounting the plate member 3 to the sole of the ski boot 2, there is provided a plurality of screw receiving holes 10.

While symmetrical about the longitudinal axis thereof, the lateral edges 4 and 5 of the plate member 3 are asymmetrical with respect to its transverse midline designated as 13.

The length and angle of the forward portion of the curved lateral edges 4 and 5 are such that the position of the width of the plate 3 at its narrowest point is located rearward of the midline 13 by an amount corresponding to the distance the ski boot must be moved forwardly for the rear of the ski boot to clear the forward edges of a pair of heel receiving members 30 and 31 when the ski boot is secured in the binding 1 as described below.

In the binding 1 there is provided for engaging the plate member 3 a pair of side clamping members 16 and 17. The clamping members 16 and 17 are each provided with an inwardly directed protuberance 18 and 19 which, when the binding 1 is closed overlay the lateral edges 4 and 5 of the plate member 3.

For providing a clamping force to the clamping members 16 and 17 there is provided a connecting member 18, which extends in a cavity provided therefor between the clamping members 16 and 17 to the rear of the binding 1. At its rear end, the connecting member 18 is provided with a pair of upstanding members 20 and 21. The members 20 and 21 are provided for movably coupling the connecting member 18 to a spring guide rod 22 in an overcenter spring mechanism designated generally as 23.

In the overcenter spring mechanism 23 there is provided a spring member 24 and a washer member 25. Coupled to the end of the rod 22 there is provided an adjusting nut 26. To mount the binding 1 to the upper surface of the ski there is provided a plurality of screw receiving holes 27.

At the rear of the binding 1, on opposite sides of the connecting member 18 and the spring guide rod 22, there is provided the pair of curved heel locating members 30 and 31. The members 30 and 31 are provided respectively with a curved forward surface 32 and 33. The curve of the surfaces 32 and 33 corresponds to the shape of the rear surface of the ski boot 2.

Located between the clamping members 16 and 17 there is provided a trigger member 35. The trigger member 35 is provided for closing the clamping members 16 and 17 with respect to the plate member 3 as described below and as further described in detail in U.S. Pat. No. 3,905,613.

Figure 4:
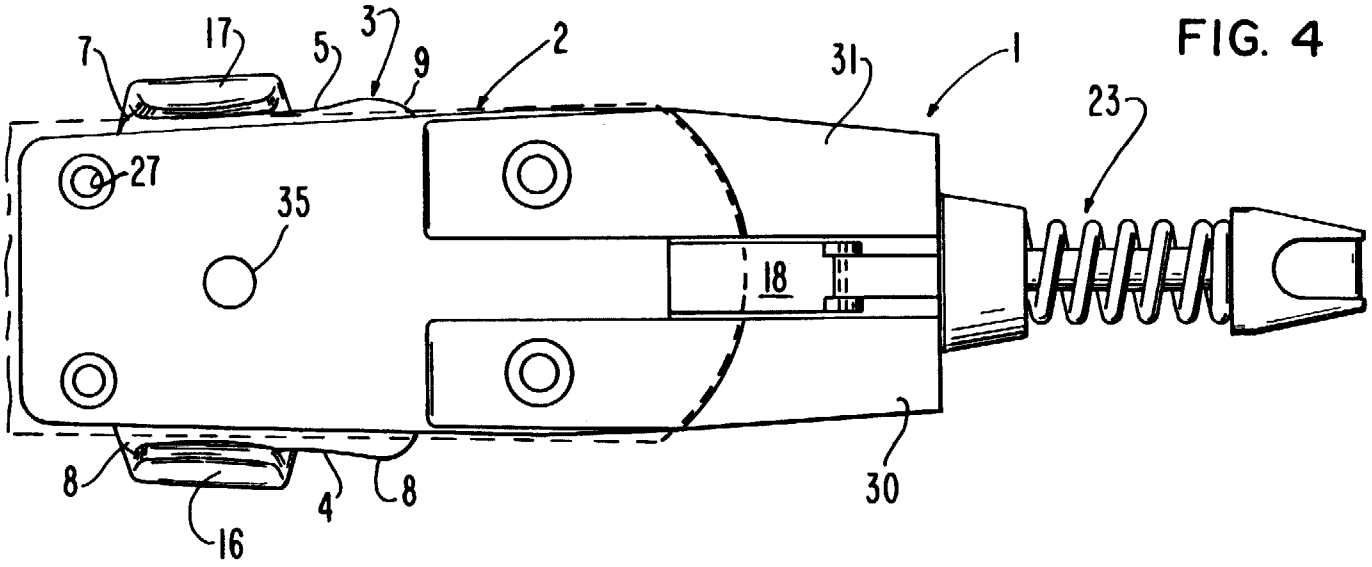
FIG. 4 is a plan view of the binding of FIG. 1 in an open condition.

In use, and as described in U.S. Pat. No. 3,905,613, the binding 1 is set by raising the spring mechanism 23 from its horizontal position as shown, to a vertical position. With the spring assembly 23 raised to its vertical position tension is removed from the spring rod 22 and the connecting member 18 allowing the clamping members 16 and 17 to be moved outwardly to their open position as shown in FIG. 4. With the connecting member 18 moved forwardly the trigger member 35 is elevated by a spring member (not shown). With the trigger member 35 in its elevated position, the spring assembly 23 is lowered to its horizontal position as shown in FIGS. 1 and 4. The lowering of the spring assembly to its horizontal position applies the clamping force of the spring 24 to the spring guide rod 22 and the connecting member 18; however, with the trigger member in its elevated position, the clamping members 16 and 17 are kept in their open position until the trigger member 35 is depressed.

Figure 5:
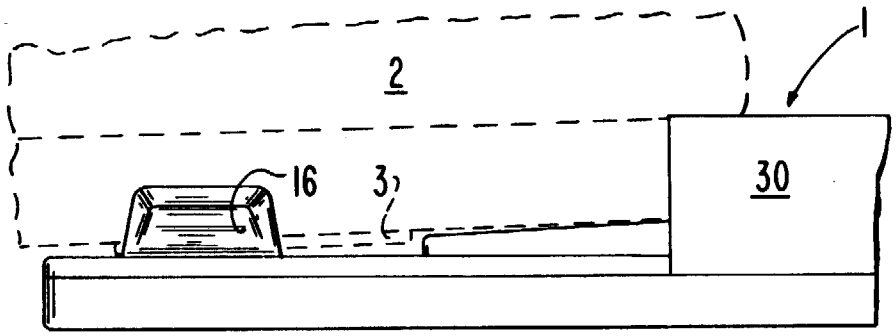
FIG. 5 is a partial side elevation view of FIG. 4.

With the clamping force applied to the connecting member 18 and the clamping members 16 and 17 held in their open position by the trigger member 35, a skier places the heel of a ski boot against the surfaces 32 and 33 as shown in FIGS. 4 and 5. As the heel of the ski boot is placed against the surfaces 32 and 33, the ski boot 2 is lowered between the clamping members 16 and 17. As the ski boot 2 is lowered between the clamping members 16 and 17 the plate member 3 contacts the trigger member 35 and depresses the trigger member 35. When the trigger member 35 is fully depressed the trigger member 35 disengages the connecting member 18. When the trigger member 35 is disengaged from the connecting member 18, the connecting member 18 is drawn rearwardly by the spring 24. As the connecting member 18 is drawn rearwardly by the spring 24, the clamping members 16 and 17 coupled to the forward end thereof are drawn inwardly engaging the plate member 3.

Figure 3:
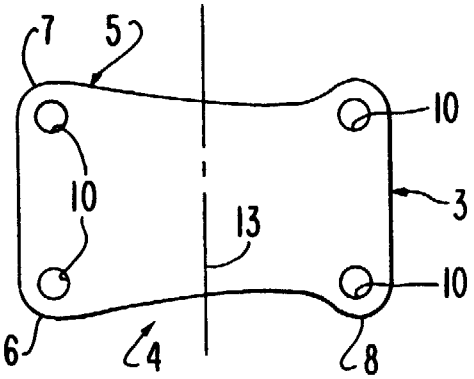
FIG. 3 is a plan view of a plate adapted for mounting to the sole of a ski boot for use of the binding of FIGS. 1 and 2.
Figure 2:
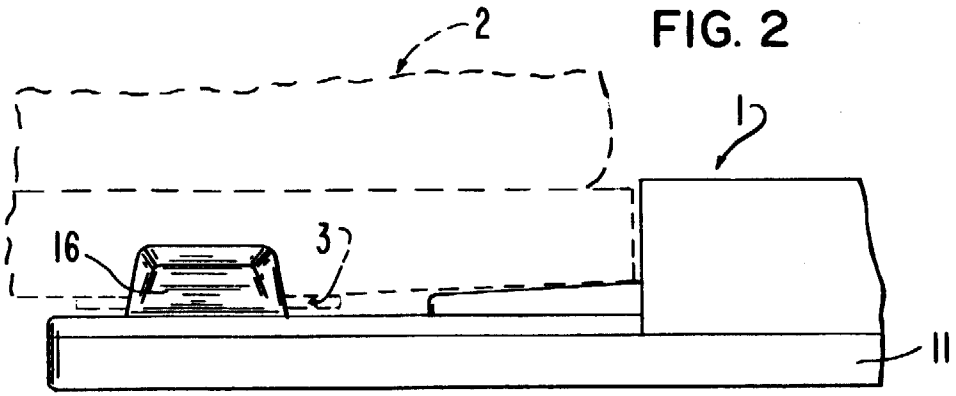
FIG. 2 is a partial side elevation view of FIG. 1.

As the clamping members 16 and 17 engage the lateral edges 4 and 5 of the plate member 3 the plate member 3 is drawn forwardly until the narrowest part of the plate member 3 is centered between the clamping members 16 and 17. As can be seen in FIG. 3 and as described above, the narrowest part of the plate member 3 is located at a distance rearward of the midline 13 by an amount sufficient for the heel of the ski boot 2 to clear the forward edge of the heel locating means 30 and 31 during a lateral release.

While an embodiment of the present invention is disclosed and described it is contemplated that various modifications may be made thereto without departing from the spirit and scope of the present invention. For example the present invention is described with movable side clamping members mounted to the surface of a ski and a rigid plate having curved lateral edges mounted to the sole of a ski boot. The functions of the ski and boot mounted members may be reversed by mounting the movable part in the sole of a ski boot and mounting rigid upstanding members on the surface of a ski as disclosed in applicant's U.S. Pat. No. 3,606,370. For this reason is intended that the scope of the present invention be determined not by reference to the embodiment disclosed but by the claims hereinafter provided and their equivalents.

What is claimed is:

1. A ski binding having means for securing a ski boot to a ski rearward of the toe and forward of the rear of the heel of the ski boot and means for locating the heel of the ski boot in a predetermined position relative to said securing means preparatory to securing said ski boot in said binding, said binding comprising:

(a) ski mounted heel receiving means having a curved surface corresponding to the shape of the rear surface of the heel of said ski boot, (b) a boot mounted plate with inwardly curved side edges, the narrowest width of said plate being located toward the aft portion thereof, and (c) a pair of ski mounted side clamping members for engaging said curved side edges, whereby when said clamping members engage said plate, said plate is drawn forwardly until said clamping members are in engagement with said narrowest width of said plate and said heel portion of said boot is at a sufficient distance from said heel receiving means to clear the forward edges thereof upon lateral release of said boot.

* * * * *